US005707298A

United States Patent [19]

Chovanes

[11] Patent Number: 5,707,298

[45] Date of Patent: Jan. 13, 1998

[54] IMPLEMENT SWING TRAINING DEVICE

[76] Inventor: Joseph E. Chovanes, 2162 County Line Rd., Ardmore, Pa. 19003

[21] Appl. No.: 341,764

[22] Filed: Nov. 18, 1994

[51] Int. Cl.[6] ..... A63B 69/36

[52] U.S. Cl. ..... 473/223; 473/422

[58] Field of Search ..... 273/26 B, 29 A, 273/54 B, 186 R, 73 R, 186 A, 183 B, 26 R, 186.2; 367/135; 473/151, 152, 154, 220–226, 233, 234

[56] References Cited

U.S. PATENT DOCUMENTS

| | | | |
|---|---|---|---|
| 1,876,657 | 9/1932 | Fox | 472/223 |
| 3,122,365 | 2/1964 | August | 273/26 B |
| 3,270,564 | 9/1966 | Evans | 273/186.2 |
| 3,380,305 | 4/1968 | Charell | 273/26 B |
| 3,436,076 | 4/1969 | Barthol | 273/26 B |
| 3,776,556 | 12/1973 | McLaughlin . | |
| 3,860,247 | 1/1975 | Taylor . | |
| 3,870,316 | 3/1975 | DeBrocks . | |
| 3,965,488 | 6/1976 | Paulucci . | |
| 3,970,987 | 7/1976 | Kolm | 367/135 |
| 3,979,125 | 9/1976 | Lancellotti . | |
| 4,022,475 | 5/1977 | Todd . | |
| 4,053,160 | 10/1977 | Salata . | |
| 4,119,318 | 10/1978 | de Kremer et al. . | |
| 4,155,555 | 5/1979 | Fink . | |
| 4,251,077 | 2/1981 | Pelz et al. . | |
| 4,257,594 | 3/1981 | Conrey | 273/29 A |
| 4,576,378 | 3/1986 | Backus . | |
| 4,736,952 | 4/1988 | Taft . | |
| 4,788,863 | 12/1988 | Tanka | 273/26 B |
| 4,789,159 | 12/1988 | Kane . | |
| 4,789,160 | 12/1988 | Dollar | 273/26 B |
| 4,805,912 | 2/1989 | Hickman . | |
| 4,822,042 | 4/1989 | Landsman | 273/26 B |
| 4,834,376 | 5/1989 | Steinberg | 273/26 B |
| 4,879,935 | 11/1989 | Gerber . | |
| 4,898,389 | 2/1990 | Pluff | 473/223 |
| 4,902,016 | 2/1990 | Boone . | |
| 4,911,441 | 3/1990 | Brunner | 273/26 B |
| 5,031,909 | 7/1991 | Pecker | 273/186.2 |
| 5,064,197 | 11/1991 | Eddy . | |
| 5,174,577 | 12/1992 | Warde et al. . | |
| 5,322,285 | 6/1994 | Turner . | |
| 5,430,512 | 7/1995 | Tattershall | 473/220 |

FOREIGN PATENT DOCUMENTS

| | | | |
|---|---|---|---|
| 3414467 | 1/1985 | Germany | 273/29 A |
| 3929459 | 1/1991 | Germany | 273/29 A |
| 35200536 | 7/1977 | Japan | 273/186.2 |
| 1547834 | 3/1990 | U.S.S.R. | 273/29 A |
| 9106348 | 5/1991 | WIPO | 273/29 A |

OTHER PUBLICATIONS

The Gold Store Catalog, p. 24, Austin, TX (Sep., 1994).

The Hammacher Schlemmer Catalog, p. 11 (Summer, 1990).

*Primary Examiner*—Theatrice Brown

[57] ABSTRACT

A training device for those sports and games which utilize an implement to strike a projectile is disclosed. A pressure sensitive switch is placed on the implement in the area where it is desired that the projectile be struck. Contact with the projectile will activate the switch, which closes a circuit. This closing will be indicated by a sound generator. Thus the player has practically instantaneous feedback on the contact area.

4 Claims, 2 Drawing Sheets

IMPLEMENT SWING TRAINING DEVICE

FIELD OF THE INVENTION

This invention concerns teaching aids for sporting activities. More particularly, it concerns a teaching aid for sports and games wherein a ball or other projectile is struck by an implement.

BACKGROUND OF THE INVENTION

Sports and games such as golf and baseball have, as a central feature, the forceful and accurate striking of a ball or other projectile by an implement. The forceful and accurate striking is facilitated by hitting the projectile with a specific area of the implement, commonly known as the sweet spot, which best transmits the energy of the swing from the implement to the projectile. The sweet spot may be located on a specific area of the implement designed for striking an object, such as the face of a golf club, or it may be a location along the length of the implement, such as on a baseball bat.

It may be difficult for the player to learn how to consistently strike the sweet spot, because of the many variables that are involved in learning how to swing an implement. It may also be difficult for the player to learn to strike the projectile cleanly, that is with maximum contact between the implement and the projectile, and without rolling the projectile along the implement. This rolling would tend to impart a spin or english to the projectile, which may be used to place a struck projectile accurately by an expert player, but all too often interferes with the straight projectile path the beginner is trying to develop. Additionally, it is often desirable to strike the projectile with a perpendicular implement face, rather than a slanted implement face, which as well might add undesirable english to the projectile.

Although it is desirable for a beginner to focus on hitting the projectile on the sweet spot, a more advanced player may well wish to strike the projectile in a number of areas of the implement, in order to affect its subsequent path in a desired manner.

Training aids that assist the player in developing an accurate swing are passive, that is, assist the player without actually striking any projectile, or active, which assist the player while actually striking a projectile.

The aids which would best seem to assist a player in developing a feel for the area on the implement that is striking the projectile are the active aids. This is because the act of actually striking the projectile may influence the variables attendant to striking the ball properly. One example of this is in golf, where a loose grip may cause the club face to rotate upon striking the ball, and thus lead to the ball undesirably curving while in flight, because it has rolled along the face or been struck by a non-perpendicular face on an angle along the horizontal dimension, i.e., parallel to the ground.

The art of active aids is well known. In golf, for example, one method of determining the area where the player has struck the ball on the club face is by use of impact tape, a strip of which is placed on the club face. When the ball is struck, the impact leaves a mark on the tape, which can then be examined by the player to determine where on the club face the ball has been hit. The player can then adjust his swing if necessary in order to have the ball be struck in a different position on the club face.

One drawback to the prior art is that it often involves delayed feedback, that is instantaneous or near instantaneous feedback upon the moment of striking the projectile is not available. As with the impact tape example the examination of the club face necessitates a readjustment of the golfer in order to examine the club face. Additionally, the prior art may not indicate if the projectile has been struck cleanly, that is, if it has not been rolled along the implement's striking area. See, for example, U.S. Pat. No. 4,576,378. Another drawback is that the equipment used to assist the player may be cumbersome and unwieldy, as in the prior an which requires the player to operate within some sort of frame as they swing the implement. See, for example, U.S. Pat. No. 4,736,952.

One more problem with the prior art should be noted. The use of any device attached to the implement may affect the actual swing, as the player would be required to compensate for that weight as well as the weight of the implement. Therefore, it is desirable that any aid be of light enough weight so that it does not materially affect the implement weight.

Accordingly, it is an object of the present invention to provide a device which generates near instantaneous feedback to the player upon striking a projectile with an implement regarding the location of the strike.

It is another object of the present invention to provide a device which is inexpensive to manufacture, easy to use, and light weight.

SUMMARY OF THE INVENTION

The present invention provides a self-contained apparatus comprising a switch connected to a circuit and a means for indicating the location of impact between projectile and an implement. In one embodiment a switch is mounted on the striking surface of the implement and comprises two spaced apart thin metal plates with a slight separation between them. The first plate pivots and contacts the second plate when struck by the projectile thus closing the switch. The circuit comprises a power source and a sound generating integrated circuit (IC) chip with speaker. The closing of the switch supplies power to the IC chip which in turn drives the speaker. If the projectile is not struck on the area where the metal plates are mounted, there will be no closing of the circuit and thus no sound.

In other embodiments, differing types of switches or a number of switches or generators, which may be sound generators or light generators, or a combination thereof may be used. These would serve to give indications, by their differing feedback, of various points of contact. Alternatively, an acoustic switch, tuned to the various vibrations that contact with a specific area would produce, could be employed instead of the contact switch plates. This switch would be mounted on the backside or other place sufficient to detect the vibration of the implement when, or immediately after, it strikes the projectile.

DETAILED DESCRIPTION OF THE INVENTION

Figure 1:
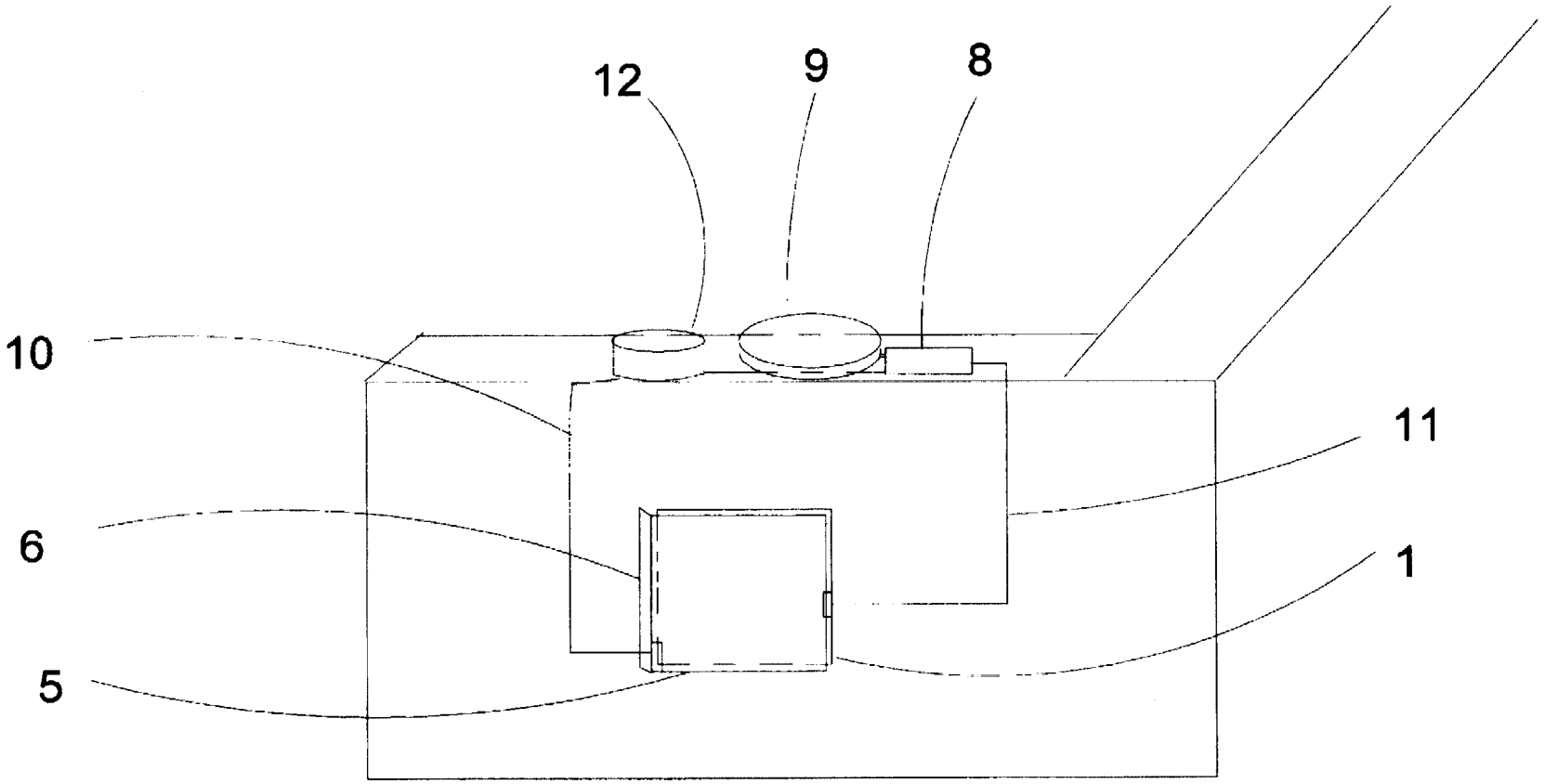
FIG. 1 is a perspective view of a preferred embodiment of the present invention.

FIG. 1 shows the utilization of a preferred embodiment on a golf club. The switch components 1 and 5 may be comprised of any metal which conducts sufficient electricity when the circuit is closed, such as copper. The components are in spaced relation whereby the switch is open in the resting state. Component base 6, made of plastic, provides a flexible, resilient pivot point for component 5 so that switch component 5 will rebound after being struck and thus reopen the circuit.

The power supply 12 can comprise a simple, commonly available alkaline cell, although any power source light enough and powerful sufficient to supply current to the generator is acceptable. Particularly preferred are alkaline cells sold for uses in watches, hearing aid and the like because of their compact size and minimal weight. The embodiment shown on FIG. 1 has the battery mounted on top of the club face, but it can be readily appreciated that the battery may be located in any position outside the area of impact.

The generator takes the form of a sound generation speaker 9 and a sound producing integrated circuit 8. Both of these are commercially available. They are of sufficiently light weight to permit application to an implement without materially affecting the swing weight of the implement. Auditory feedback is deemed more desirable than visual, since sight is already engaged in the striking process. Thus sound feedback is more likely to be effective for the player, although visual feedback can be used as well, such as a light emitting diode or LED. There also may be a multiplicity of switches, as well as a multiplicity of generators. These can be utilized in such a manner that the activation of more than one switch and generator will indicate that the projectile has rolled along the implement while being struck. Thus the projectile has not been struck cleanly by the player and will have a degree of english imparted. A multiplicity of switches and generators could also be used to indicate where the projectile has struck the implement whereby different generators would be connected to switches on various potential striking areas of the implement.

It is also possible to utilize a delay in the circuit. Thus, in one embodiment a delay may be interposed into the circuit between the switch and the generator so that if the projectile lingers on the switch during the swing, the circuit will be opened by the delay. Thus, the sound generator will be cut short after sounding initially. This interrupted sound will indicate that the projectile has not been struck cleanly and has lingered on the face of the club.

The switch components can be various shapes and sizes. It will be appreciated that the construction of the switch for use on any implement is a function of the implement and projectile, so that for example an embodiment suited for mounting on a baseball bat, will be generally of larger size in the pressure switch area than a golf club mounted device although a small pressure switch for a bat may be desirable if precision hitting is being taught.

It will also be appreciated that the switch can be of any configuration wherein it maintains the circuit off until being struck. For example, it could be possible to use an acoustic switch tuned to close the circuit only at the frequency characteristic of various parts of the implement, for example, the sweet spot of the implement. This may vary from implement to implement, and be determined by such factors as the materials used in the construction of the implement. Additionally, component base 6 may be made of rubber or any material, providing that it provides the resiliency necessary and sufficiently insulates component 5 electrically from the club face. Without that insulative capability, the circuit would never be opened, i.e., it would short out on the club face. It is also possible with a metal implement, to eliminate the plate 1 and attach the wire 11 to the implement so that the closing of the circuit will be accomplished by a single component flexing and contacting the club face which would be wired directly to the IC chip and thus function as a switch component.

It is also possible to utilize the present invention with tennis rackets. The embodiment would be mounted on the back side of the face, that is the side opposite from where the ball is struck. Because a tennis racquet's strings actually flex upon impact, the desired activation of the pressure sensitive switch will occur on either side of the racquet. Thus if desired with a racquet or any implement where the implement appreciably flexes when struck, the device can be placed on the reverse side of the striking face.

The invention is mounted on the club face in FIG. 1 by being embedded in a pressure sensitive commonly available tape (not shown), such as Mylar® tape manufactured by DuPont, wherein the entire assembly can merely be placed on the club face and removed simply.

Other means of mounting so that the device can be attached and detached easily are possible. It should also be appreciated that it can be used while the sport or game is actually being played. It should also be understood that an implement can be constructed in such a way to incorporate the present invention within, thus leading to a permanent installation.

Figure 2:
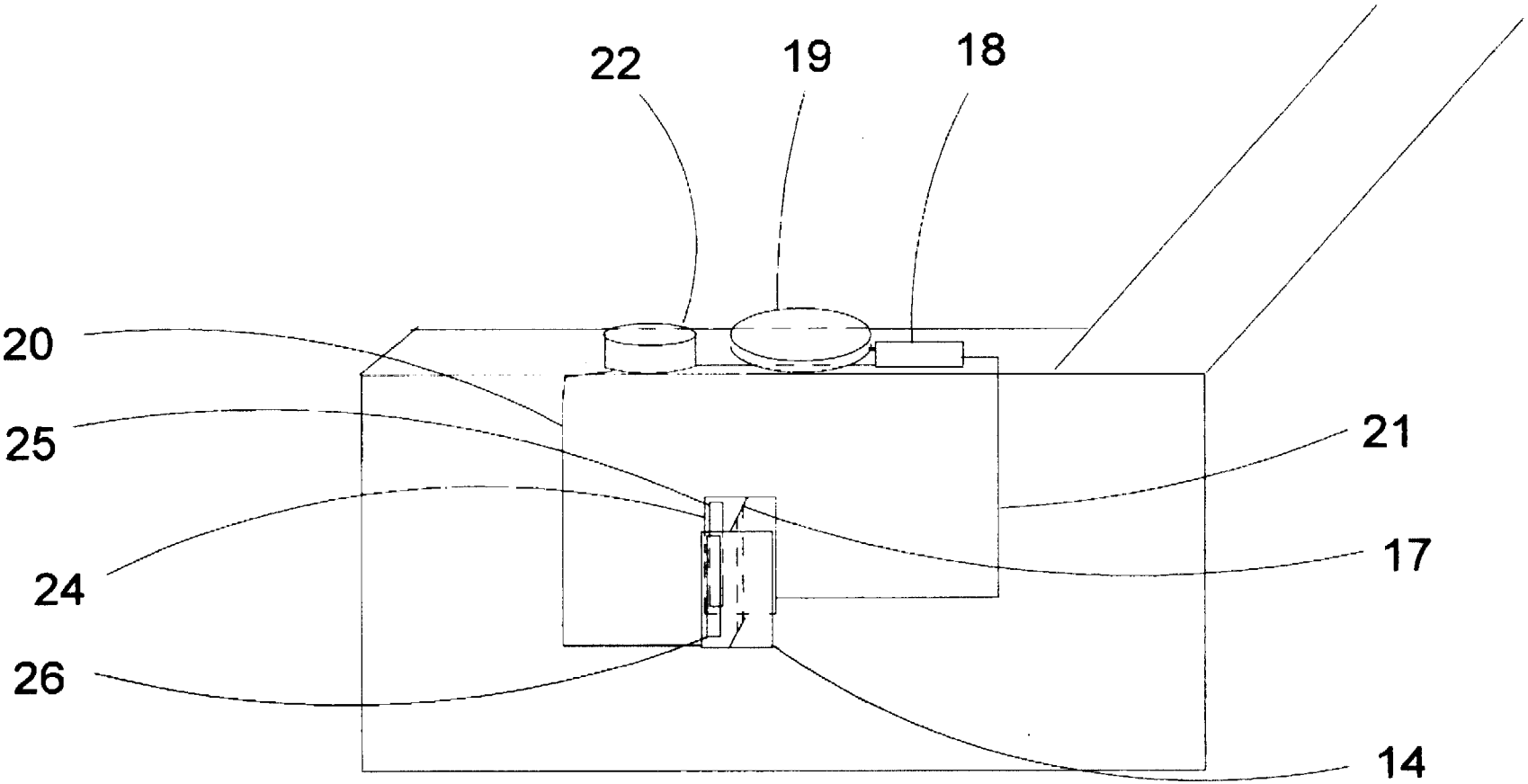
FIG. 2 is a perspective view of an alternate embodiment of the present invention.

In FIG. 2 use of a particular switch construction is shown. In this construction the switch will not be activated unless the ball is struck at a substantially 90 degree angle to the swing of the bat. This leads to the player being trained in developing a swing wherein the club face is perpendicular to the ball and thus eliminating a possibly undesirable swing wherein the ball curves off the club face even though it has been correctly hit on the indicator spot.

Switch component 14 is mounted on switch base 17. The greater portion of 14 has been masked, so that area 26 will only be exposed. The ball must strike switch base 17 so it collapses along its scored lines in an accordion fashion. A ball hit at about 90 degrees to the club face will cause that collapse. Thus the feedback will only come when the ball at the point in his swing where the ball is substantially perpendicular to the club face in the horizontal direction. This construction could also be modified to ensure in a baseball bat, for example, that the ball is struck when the club face is in a desired plane and dimension.

Upon collapsing directly backwards, area 26 will contact area 25 on component 24, and will contact area 25 on component 24, and thus the circuit will close and speaker 19 will generate sound. If the ball is not hit near 90 degrees, component 14 will pivot on 17, which in turn will not collapse in an accordion like fashion but merely pivot along its connections to plates 14 and 24. This will result in area 26 not hitting area 25 and the circuit remaining open.

The above description and the view depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

What is claimed is:

1. A device for indicating the impact of a projectile on an implement used in a sports game comprising;

a mechanical switch means comprised of first and second conductive means and a flexible, resilient pivot means, said pivot means attaching said first conductive means to said second conductive means and biasing said first conductive means away from said second conductive means;

a circuit comprised of a power source, means connecting said switch means to said power source and means for indicating when said switch means has been closed, whereby said pivot means will allow said first conductive means to contact said second conductive means and thereby close said circuit upon direct impact by a projectile, and will cause said first and second conductive means to separate thereby automatically open said circuit following said impact; and means for attaching said device to a sports implement without altering said implement.

2. The device of claim 1 whereby said means for indicating said circuit has been closed comprises a sound generator.

3. The device of claim 1 whereby said means for indicating said circuit has been closed comprises a light generator.

4. The device of claim 1 whereby said power source comprises a battery.

* * * * *